US009940770B1

(12) United States Patent
Chang et al.

(10) Patent No.: US 9,940,770 B1
(45) Date of Patent: Apr. 10, 2018

(54) COIN MACHINE USING PROXIMITY AND AMBIENT LIGHT SENSING TECHNOLOGY

(71) Applicant: INTERNATIONAL CURRENCY TECHNOLOGIES CORPORATION, Taipei (TW)

(72) Inventors: Chia-Min Chang, Taipei (TW); Shao-Po Chan, Taipei (TW); Ming-Hua Tsou, Taipei (TW); Wei Chiu, Taipei (TW); Yuan-Chun Wang, Taipei (TW); Hang-Chih Hsu, Taipei (TW)

(73) Assignee: INTERNATIONAL CURRENCY TECHNOLOGIES CORPORATION, Taipei (TW)

( * ) Notice: Subject to any disclaimer, the term of this patent is extended or adjusted under 35 U.S.C. 154(b) by 0 days.

(21) Appl. No.: 15/420,493

(22) Filed: Jan. 31, 2017

(30) Foreign Application Priority Data

Oct. 11, 2016 (TW) ..... 105132751 A

(51) Int. Cl.

| | |
|---|---|
| ***G07D 5/02*** | (2006.01) |
| ***G07D 3/02*** | (2006.01) |
| ***G07D 1/02*** | (2006.01) |
| ***G07F 5/24*** | (2006.01) |
| ***G07D 1/00*** | (2006.01) |
| ***G07D 9/06*** | (2006.01) |
| ***G07D 11/00*** | (2006.01) |

(52) U.S. Cl.

CPC ..... *G07D 5/02* (2013.01); *G07D 1/00* (2013.01); *G07D 1/02* (2013.01); *G07D 3/02* (2013.01); *G07D 9/06* (2013.01); *G07D 11/0036* (2013.01); *G07F 5/24* (2013.01)

(58) Field of Classification Search

CPC .. G07D 1/00; G07D 1/02; G07D 1/04; G07D 1/06; G07D 9/06; G07D 11/0003; G07D 11/0036; G07D 11/0081

See application file for complete search history.

(56) References Cited

U.S. PATENT DOCUMENTS 5,616,075 A * 4/1997 Winstanley ..... G07D 1/00 194/200

5,755,618 A * 5/1998 Mothwurf ..... G07F 17/32 453/17

(Continued)

*Primary Examiner* — Mark J Beauchaine

(74) *Attorney, Agent, or Firm* — Muncy, Geissler, Olds & Lowe, P.C.

(57) ABSTRACT

A coin acceptor includes main body having coin dispenser mounted therein, coin tubes mounted in the main body and disposed at the bottom side of the coin dispenser, and sensing device including multiple optical sensor modules respectively aimed at the coin tubes. The distance between each optical sensor module and the coins in the respective coin tube is calculated by: measuring the time taken for the reflected light to travel from the coins in the respective coin tube to the proximity sensor of the respective optical sensor module and then multiplying the time thus measured by the speed of light. The number of coins in each coin tube is calculated by: deducting the distance between the respective optical sensor module and the coins in the respective coin tube from the pre-measured depth of the empty coin tube, and then dividing the reminder thus obtained by the thickness of single coin.

9 Claims, 8 Drawing Sheets

(56) References Cited

U.S. PATENT DOCUMENTS

| | | | | |
|---|---|---|---|---|
| 6,045,443 | A * | 4/2000 | Weston | G07F 5/24 194/217 |
| 2003/0051970 | A1 * | 3/2003 | Furneaux | G01S 15/102 194/200 |
| 2008/0014849 | A1 * | 1/2008 | Levasseur | G07D 1/02 453/16 |

* cited by examiner

COIN MACHINE USING PROXIMITY AND AMBIENT LIGHT SENSING TECHNOLOGY

This application claims the priority benefit of Taiwan patent application number 105132751, filed on Oct. 11, 2016.

BACKGROUND OF THE INVENTION

1. Field of the Invention

The present invention relates to coin machine technology and more particularly, to a coin machine having advantages of high accuracy, rapid response and low cost, which measures the distance between the optical sensor module and the coins in the coin tube by: measuring the time taken for the reflected light to travel from the coins in the coin tube to the optical sensor module and then multiplying the time thus measured by the speed of light, and also measures the number of coins in the coin tube by: deducting the distance between the optical sensor module and the coins in the coin tube from the pre-measured depth of the empty coin tube and and then dividing the reminder thus obtained by the thickness of one single coin.

2. Description of the Related Art

Following fast development of social civilization and technology, people accelerate their pace of life and require a better quality of life. In consequence, automatic vending machines, ticket machines, currency exchange machines, game machines and other consumer service systems capable of selling commodities or providing services to consumers are used everywhere to sell different products without serviceman, bringing convenience to people and helping suppliers save much labor cost. These automatic vending machines, ticket machines, currency exchange machines, game machines and consumer service systems are coin-operated and equipped with a recognition module for recognizing the authenticity and values of inserted coins.

Further, regular automatic vending machines and game machines commonly use a coin acceptor for receiving coins so that a consumer can insert coins into the automatic vending machine or game machine to purchase commodities or to play games. The coin acceptor of a coin-operated machine generally comprises a recognition module for recognizing the authenticity and value of every inserted coin. Because different coins or tokens can be used in different countries or different amusement parks and because different coins/tokens have different sizes and values, a recognition module must be able to recognize the authenticity and values of different coins/tokens. A coin acceptor further comprises a coin dispenser adapted for sorting coins of different values into different coin tubes, a sensing device adapted for sensing the quantity of coins in each coin tube, and a coin hopper located at the bottom side of the coin tubes for outputting coins. When the quantity of coins in one coin tube reaches a predetermined high level, the sensing device gives a corresponding signal to the control circuit, prohibiting the coin dispenser from sorting any coin into this coin tube. On the contrary, when the quantity of coins in one coin tube reaches a predetermined low level, the sensing device gives a corresponding signal to the control circuit, prohibiting the hopper from outputting coins, ensuring the normal operation of the machine.

Conventional coin acceptors commonly use a non-contact displacement sensor to sense coins/tokens. Many different types of non-contact displacement sensors, such as ultrasonic sensors, optical sensors and electromagnetic sensors are commercially available. An optical sensor uses an optical transmitter to transmit light across the coin tube and an optical receiver to receive light that passes across the coin tubes. When coins are accumulated in the coin tube, they will block a part of the light that falls upon the coin tube. Subject to this shading effect, the control circuit can calculate the location of the coins in the coin tubes. An optical sensor has the advantage of low signal attenuation and is free from the interference of electronic noises or variation of coin tube sizes, and thus, it is mostly suitable for use to detect coins in a coin tube within a short distance.

However, an optical sensor that is used to detect coins in a coin tube can easily be contaminated by dust, affecting sensing accuracy. Further, the optical components wear quickly with use, lowering the performance and leading to recognition error.

Therefore, it is desirable to provide a coin machine, which is inexpensive to manufacture and can greatly improve the coin detection reliability and accuracy.

SUMMARY OF THE INVENTION

The present invention has been accomplished under the circumstances in view. It is therefore the main object of the present invention to provide a coin machine, which combines proximity sensor, ambient-light sensor and infrared light source technologies for detection of coins in coin tubes, ensuring a high level of detection accuracy and reliability.

To achieve these and other objects of the present invention, a coin machine of the present invention comprises a main body, multiple coin tubes, and a sensing device. The main body comprises a body shell, and a coin dispenser mounted in the body shell for sorting and dispensing coins of different values and sizes. The coin tubes are mounted in the body shell below the coin dispenser for collecting different values of coins from the coin dispenser, each comprising a cylindrical coin passage and an opening in a top side thereof in communication with the cylindrical coin passage. The sensing device is mounted in the body shell between the coin dispenser and the coin tubes, comprising a circuit module that comprises a plurality of optical sensor modules respectively facing toward the openings of the respective coin tubes. The distance between each optical sensor module and the coins in the respective coin tube is calculated by: measuring the time taken for the reflected light to travel from the coins in the respective coin tube to the respective optical sensor module and then multiplying the time thus measured by the speed of light. The number of coins in the respective coin tube is calculated by: deducting the distance between the respective optical sensor module and the coins in the respective coin tube from the pre-measured depth of the empty coin tube, and then dividing the reminder thus obtained by the thickness of one single coin.

Preferably, each optical sensor module of the sensing device combines a proximity sensor, an ambient-light sensor and an infrared light source into a small package. The circuit module reads in data fed by the proximity sensor and the ambient-light sensor for calculation for matching with the depth of the coin tube to judge if the coin tube is empty. If the coin tube is empty, the traveling range and reflectivity of the reflected light from the bottom of the coin tube will be changed or reduced. On the contrary, if there is no significant change in the traveling range and reflectivity of the reflected light, a following procedure of detecting the amount of coins in the coin tube is performed.

Preferably, the main body further comprises a coin hopper mounted in the body shell below the coin tubes for pushing coins out of the coin tubes for exchange, change or refund, a control module mounted in between the body shell and the coin tubes and adapted for controlling the operation of the coin hopper, and a face panel with a display unit electrically connected to the control module for indicating messages of fault condition, accumulated number of coins, delivered number of coins and rested number of coins of each said coin tube, and parameter settings. The coin hopper is controllable by the control module to shift from one coin tube that is empty to another coin tube for discharging coins subject to the detection of the sensing device. The display unit is controllable by the control module to display the message of an empty coin tube for replenishment, and the rest amounts of coins of each coin tube that is not empty so that the replenisher can decide if to make the coin tubes full of coins again.

DETAILED DESCRIPTION OF THE PREFERRED EMBODIMENT

Figure 1:
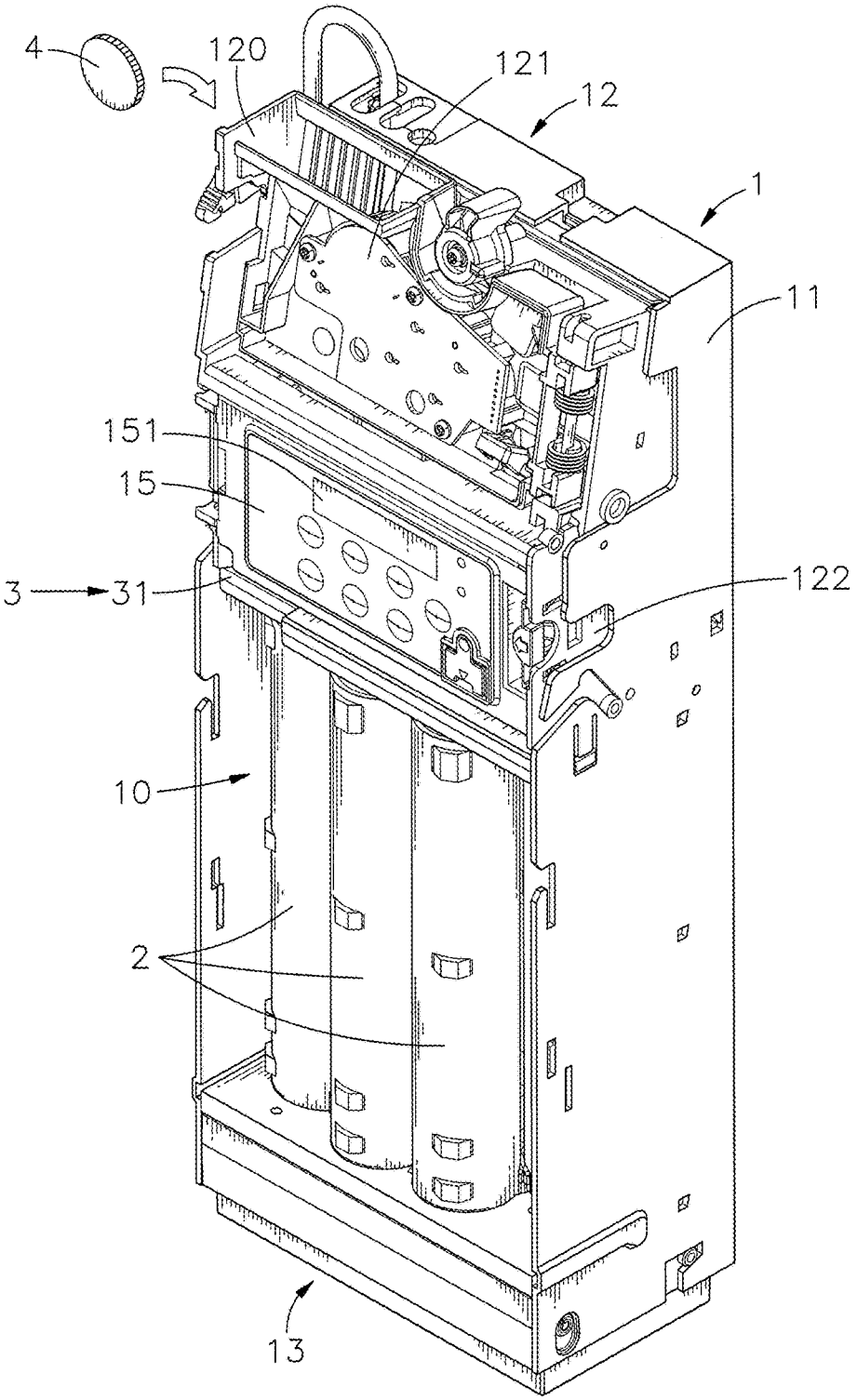
FIG. 1 is an elevational view of a coin machine in accordance with the present invention.
Figure 2:
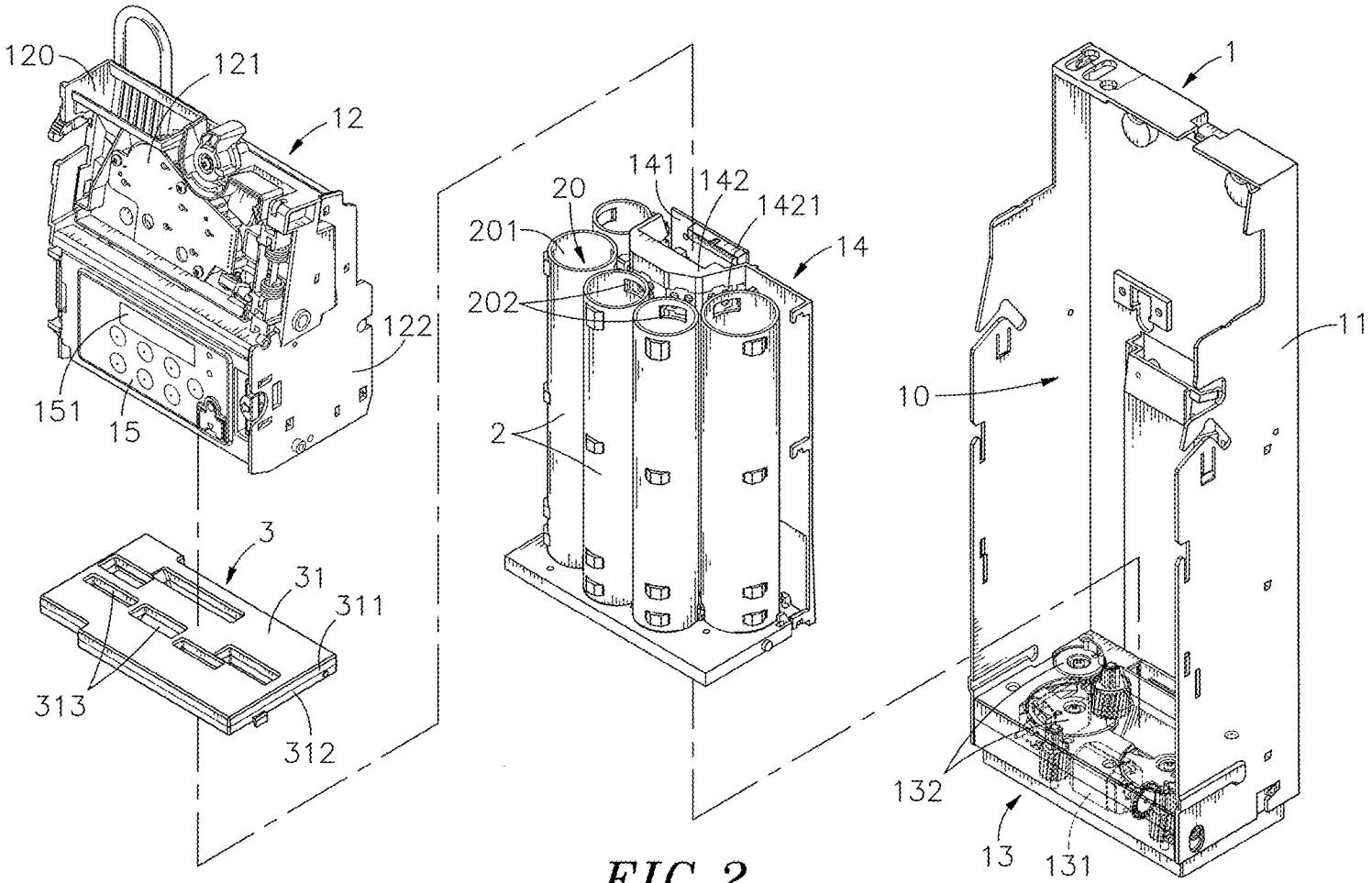
FIG. 2 is an exploded view of the coin machine in accordance with the present invention.
Figure 3:
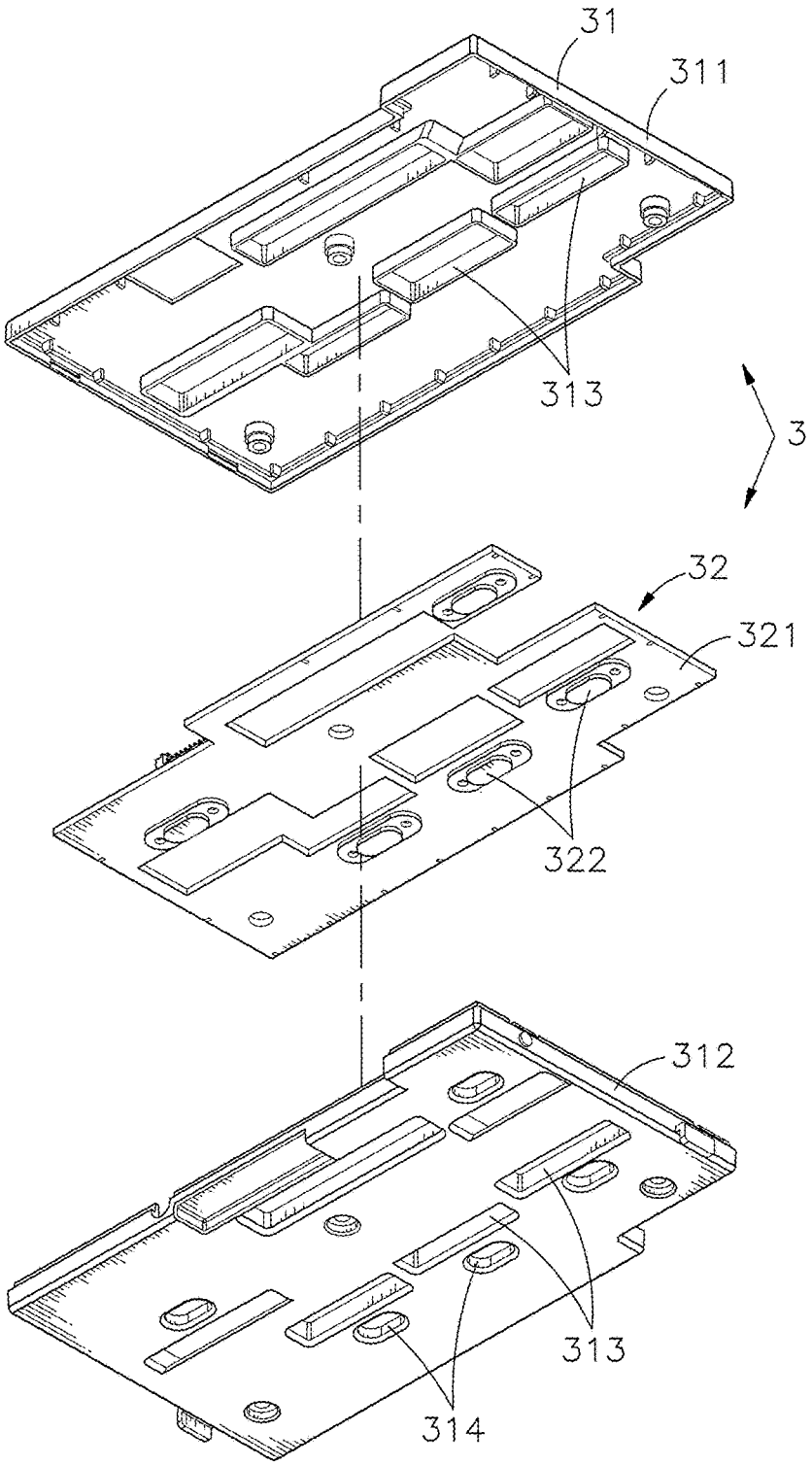
FIG. 3 is an exploded view of the sensing device of the coin machine in accordance with the present invention.
Figure 4:
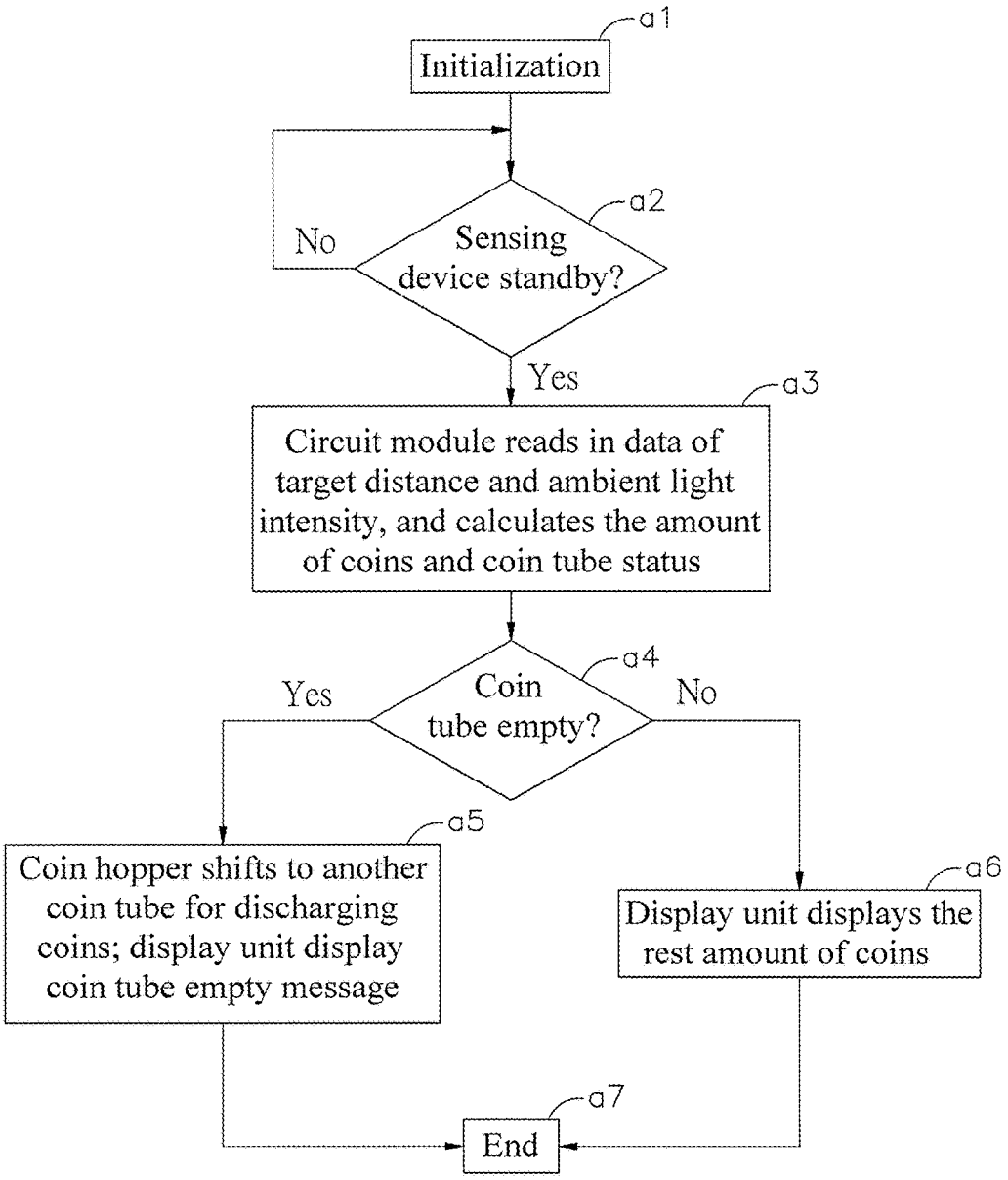
FIG. 4 is an operational flow chart of the sensing device of the coin machine in accordance with the present invention.

Referring to FIGS. 1-4, a coin machine in accordance with the present invention is shown. As illustrated, the coin acceptor comprises a main body 1, a plurality of coin tubes 2 and a sensing device 3.

The main body 1 comprises a body shell 11, a coin dispenser 12 located in a top side of the body shell 11, an accommodation chamber 10 defined in the body shell 11 at a bottom side relative to the coin dispenser 12 and adapted for accommodating the coin tubes 2, and a coin hopper 13 located in a bottom side of the body shell 11 inside the accommodation chamber 10. The coin dispenser 12 comprises a recognition module 121 adapted for recognizing the authenticity and values of different coins 4, a coin inlet 120 located in a top side of the recognition module 121 for guiding each inserted coin 4 into the recognition module 121, and a coin sorter module 122 adapted for sorting each recognized coin 4 and guiding it into one corresponding coin tube 2. The coin hopper 13 is adapted for pushing coins 4 out of the coin tubes 2 for exchange, change or refund, comprising a driving circuit-based circuit board (not shown), a plurality of motors 131 electrically connected to the driving circuit-based circuit board and drivable by the driving circuit-based circuit board, a plurality of coin-delivering rotating disks 132 rotatable by the respective motors 131, and displacement sensors (not shown) installed in the driving circuit-based circuit board for detecting the angular position of the respective coin-delivering rotating disks 132.

The main body 1 further comprises a control module 14 mounted in between a back wall of the body shell 11 and the coin tubes 2. The control module 14 comprises a power circuit board 141, and a level detection cover 142 covered over the power circuit board 141. The power circuit board 141 comprises a control circuit (not shown), and a plurality of strip lights (not shown) for emitting light toward the level detection cover 142. The level detection cover 142 comprises a plurality of detection strips 1421 respectively disposed to face toward top and bottom sides of the peripheries of the coin tubes 2 for concentrating light, enabling sensor means of the control circuit to detect a low level position or full level position of accumulated coins 4 in the respective coin tubes 2 so that the control circuit can start or stop the coin hopper 13 for the implementation of an exchange, change or refund operation. The main body 1 further comprises a face panel 15 with a display unit 151 thereof electrically connected to the control circuit of the control module 14 for indicating messages of fault condition (such as coin jamming, line fault, or any other error message), accumulated number of coins, delivered number of coins and rested number of coins of each coin tube 2, and parameter settings.

The coin tubes 2 are cylindrical tubes adapted for accommodating different values of coins 4, each comprising a cylindrical coin passage 20 in a respective specific diameter or configuration for receiving coins 4 of a respective specific diameter or configuration, opposing openings 201 respectively located in opposing top and bottom sides thereof in communication with the cylindrical coin passage 20, and two transverse through holes 202 cut through the peripheral wall thereof and respectively disposed adjacent to the openings 201 to aim at respective detection strips 1421 the level detection cover 142 of the control module 14. When a coin 4 moves over the openings 201, the sensor means of the control circuit of the control module 14 detects a shadow change, determining the coins 4 in the respective coin tube 2 in the low level or full level position.

The sensing device 3 is mounted in the body shell 11 of the main body 1 between the coin dispenser 12 and the coin tubes 2, comprising a baffle-like base 31 consisting of a first cover shell 311 and a second cover shell 312, and a circuit module 32 mounted in between the first cover shell 311 and second cover shell 312 of the baffle-like base 31. The baffle-like base 31 comprises a plurality of coin slots 313 cut through the first cover shell 311 and the second cover shell 312 for the passing of different values of coins 4 to go into the respective coin tubes 2, a plurality of sensor hole 314 respectively located on the second cover shell 312 of the baffle-like base 31 adjacent to the respective coin slots 313 and respectively aimed at the openings 201 of the coin tubes 2. The circuit module 32 comprises a circuit board 321 with a detection circuit built therein, and a plurality of optical sensor modules 322 located on a bottom surface of the circuit board 321 and respectively extended out of the respective sensor holes 314. The optical sensor modules 322 each combine a proximity sensor, an ambient-light sensor (ALS), and an infrared type vertical-cavity surface-emitting laser (VCSEL) into a three-in-one sensor package. The optical sensor modules 322 are based on time-of-flight range sensing technology for measuring the range to the target object distance and the intensity of ambient light of high dynamic range where distance and ambient light level measurements are read through a digital $I^2C$ interface.

The coin machine of the present invention can be used in an automatic vending machine, ticket machine, currency exchange machine, game machine, or any of a variety of other consumer service systems capable of selling commodities or providing services to consumers. In application, the main body 1 of the coin machine of the present invention is mounted in the host of the automatic vending machine, ticket machine, currency exchange machine, game machine, or consumer service system, enabling the main body 1 and the sensing device 3 to be electrically connected to the power and control circuit of the automatic vending machine, ticket machine, currency exchange machine, game machine, or consumer service system so that the automatic vending machine, ticket machine, currency exchange machine, game machine, or consumer service system can provide added functions of currency exchange, community purchase and consuming services.

When the sensing device 3 of the coin machine is initiated for detecting the number of coins 4 in each coin tube 2 and the status of each coin tube 2, it runs subject to the procedures as described below:

(a1) starting initialization before coin dispensing;

(a2) asking whether or not the sensing device 3 is in the standby state, and then proceeding to step (a3) if the sensing device 3 is in the standby state, or repeating the procedure of asking if the sensing device 3 is not in the standby state;

(a3) circuit module 32 reading in the data of the distance of the accumulated coins 4 in one coin tube 2 and the related ambient light fed by the optical sensor module 322, and then calculating the number of coins 4 and the current status of the respective coin tube 2 according to the fetched data;

(a4) judging whether or not the coin tube 2 is empty, and then proceeding to step (a5) if the coin tube 2 is empty, or step (a6) if not;

(a5) enabling the coin hopper 13 to shift to another coin tube 2 for dispensing coins, and driving the display unit 151 of the face panel 15 to the message of "Empty" of the respective coin tube 2, and then proceeding to step (a7);

(a6) enabling the display unit 151 of the face panel 15 to display the rest number of coins 4, and then proceeding to step (a7); and (a7) ended.

Figure 5:
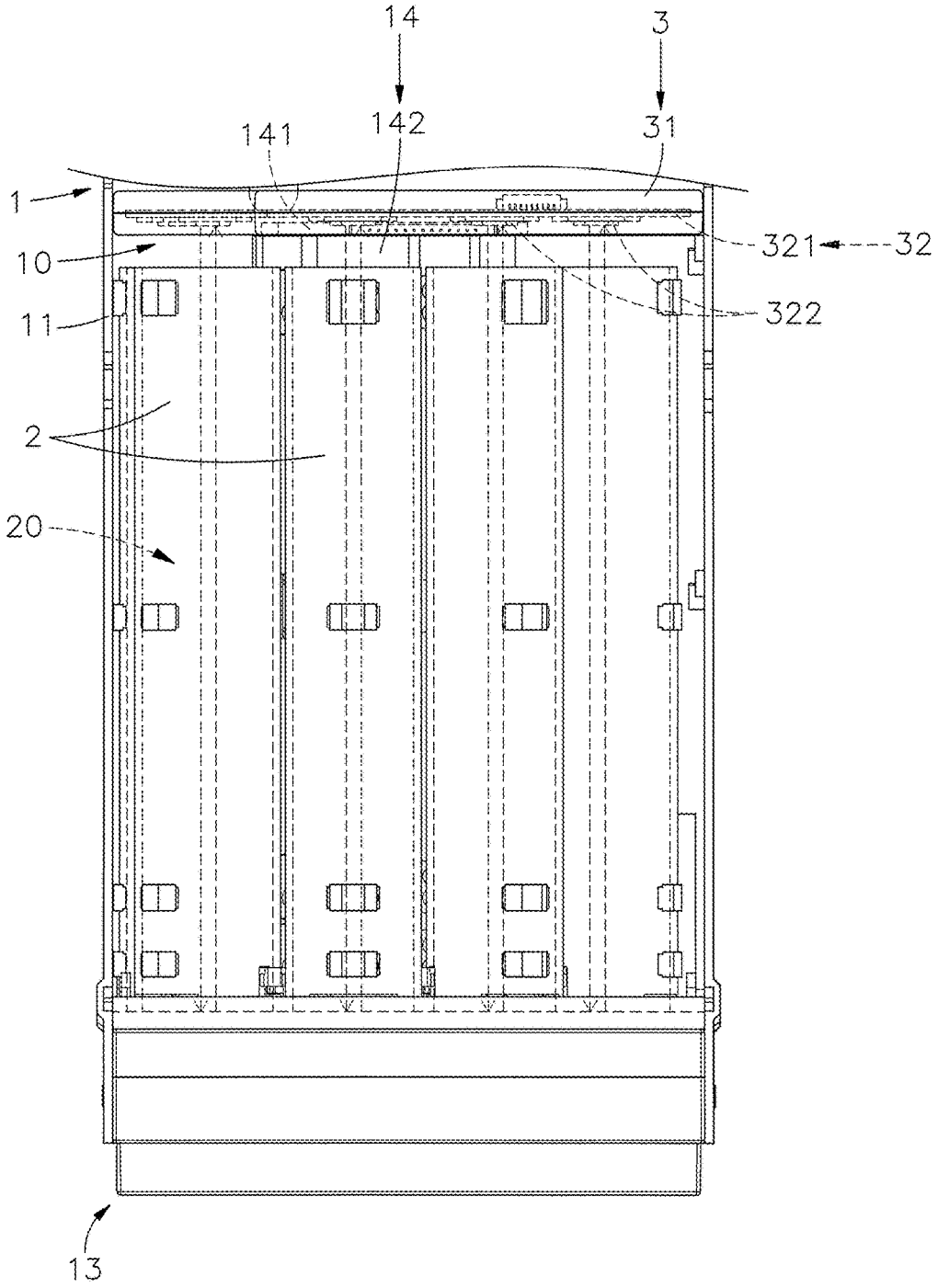
FIG. 5 is a schematic sectional view of the present invention, illustrating the sensing device in detection of one empty coin tube.
Figure 6:
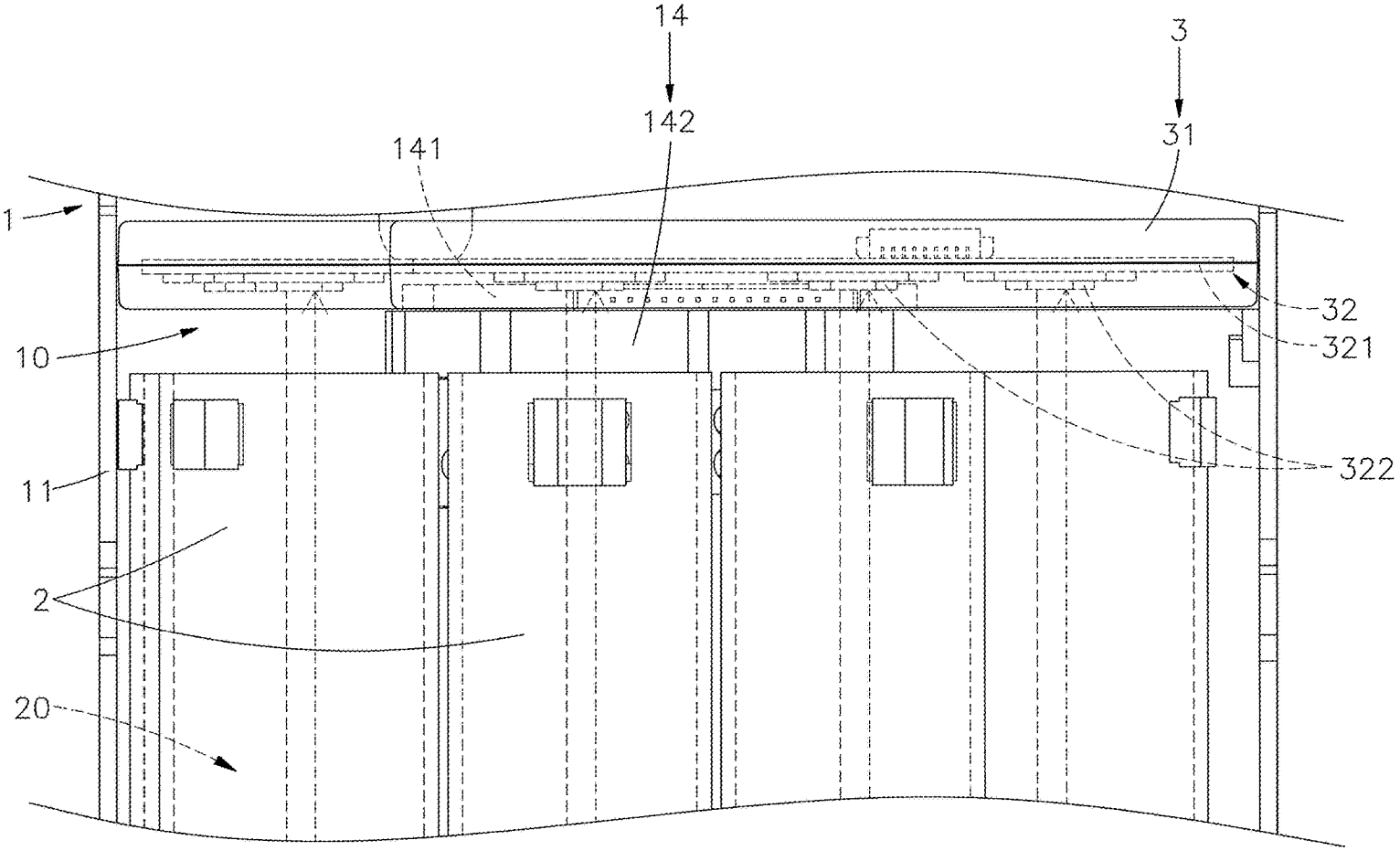
FIG. 6 is an enlarged view of a part of FIG. 5.
Figure 7:
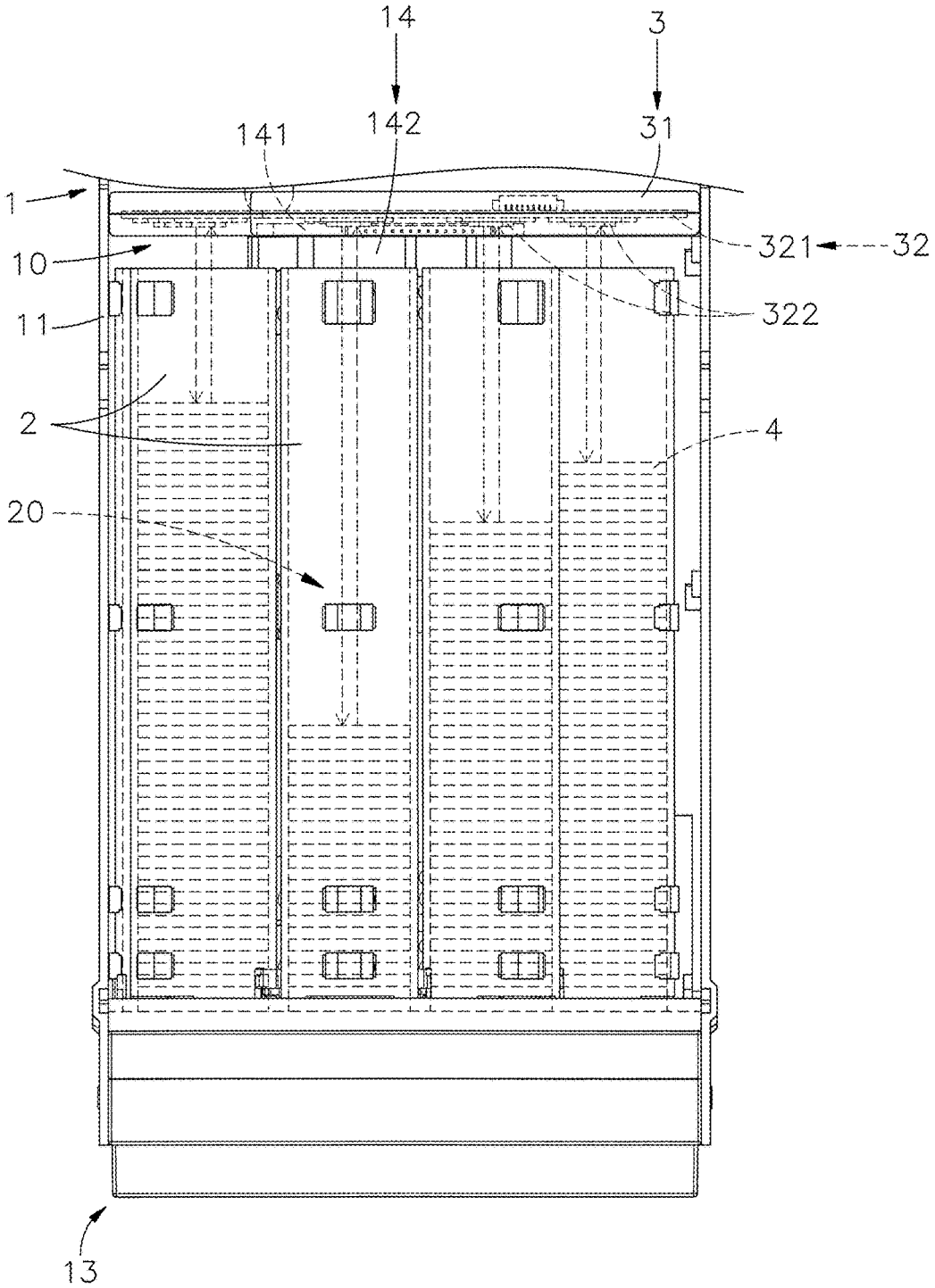
FIG. 7 is a schematic sectional view of the present invention, illustrating the sensing device in detection of coin accumulation status in the coin tubes (I).
Figure 8:
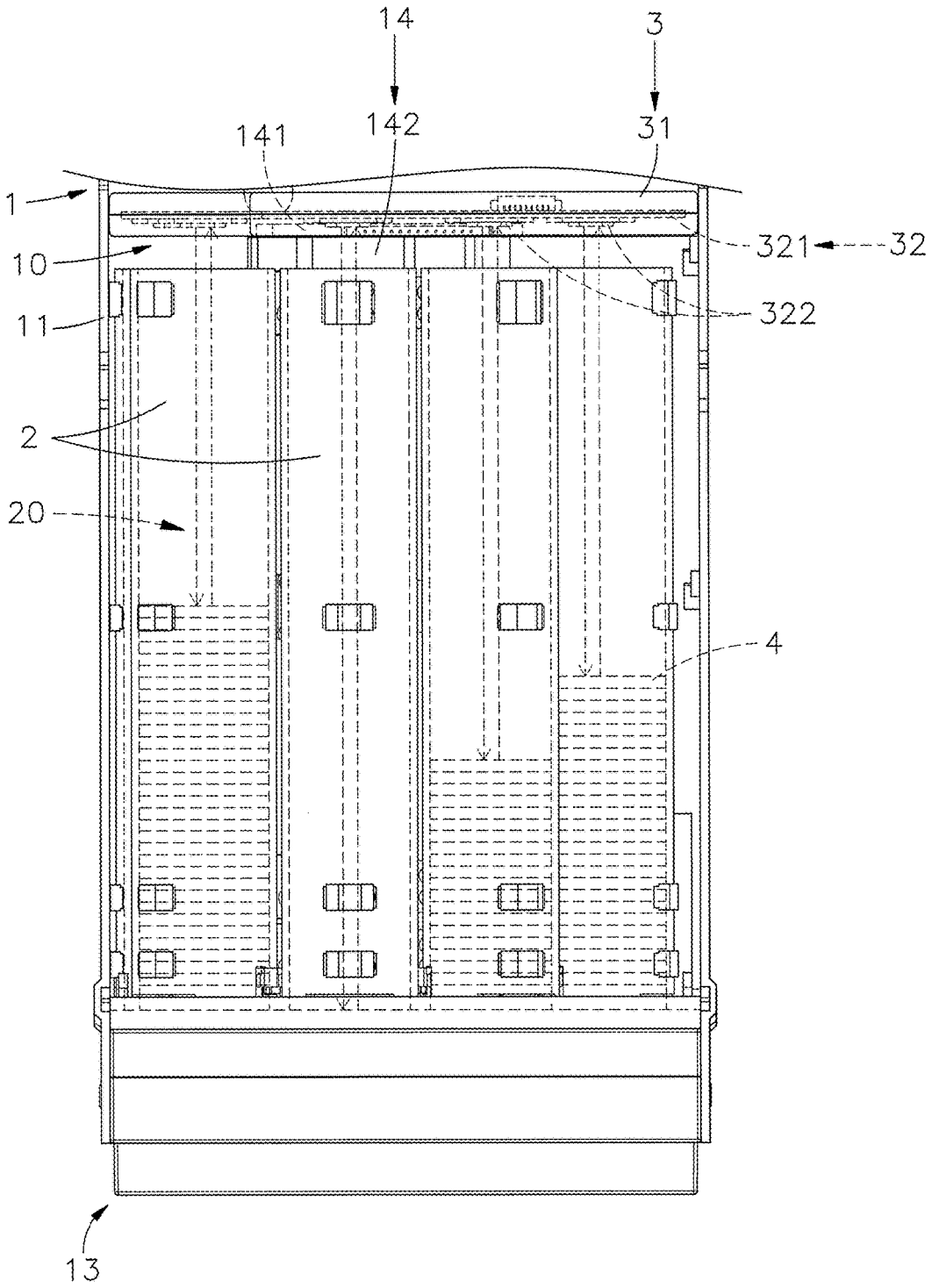
FIG. 8 is a schematic sectional view of the present invention, illustrating the sensing device in detection of coin accumulation status in the coin tubes (II).

Referring to FIGS. 5-8, when a user inserted a coin 4 into the coin insertion slot of the automatic vending machine, ticket machine, currency exchange machine, game machine, or consumer service system that is equipped with the coin machine of the present invention, or the coin inlet 120 of the coin dispenser 12 of the main body 1, the recognition module 121 is activated to recognize the authenticity and value of the inserted coin 4. If the coin 4 is a true coin, it will be sorted by the coin sorter module 122 subject to its value, and then guided into the corresponding coin tube 2 for storage. On the contrary, if the coin 4 is a counterfeit, it will be sorted by the coin sorter module 122 into a coin-return passage (not shown) in the main body 1 toward a coin-return outlet (not shown) in the face panel of the automatic vending machine, ticket machine, currency exchange machine, game machine, or consumer service system.

When coins 4 are accumulated in the cylindrical coin passage 20 of one coin tube 2, the respective optical sensor module 322 of the circuit module 32 of the sensing device 3 is driven to measure the distance to the coins 4 in the cylindrical coin passage 20 of the respective coin tube 2 and the intensity of the ambient light. The distance between the optical sensor module 322 and the coins 4 in the cylindrical coin passage 20 of the respective coin tube 2 is calculated by: measuring the time taken for the reflected light to travel from the coins 4 to the proximity sensor of the optical sensor module 322 and then multiplying the time thus measured by the speed of light. After calculation of the distance between the optical sensor module 322 and the coins 4 in the cylindrical coin passage 20 of the respective coin tube 2, the number of coins 4 in the respective coin tube 2 is calculated by: deducting the distance between the optical sensor module 322 and the coins 4 in the respective coin tube 2 from the pre-measured depth of the empty coin tube 2, and then dividing the reminder thus obtained by the thickness of one single coin 4. Further, the coins 4 in the present invention can be made of copper, nickel, aluminum, zinc, or any other alloy so that the infrared light source reflected back by the coin 4 to the optical sensor module 322 can have the maximum reflectivity. Instead of a conventional optical sensor to measure the range to the target object distance by detecting the reflectivity or signal strength of reflected light, the optical sensor modules 322 in accordance with the present invention are based on time-of-flight range sensing technology for measuring the range to the target object distance and the intensity of ambient light of high dynamic range where distance, avoiding interferences of the surface status (such as rugged surface, existence of pattern or color) of the coin. The reflectivity of the coins 4 does not affect the range measurement of the optical sensor modules 322. Subject to the design of the optical sensor modules 322, the sensing device 3 has the advantages of long distance measurement, fast response, low power consumption and low cost, ensuring high detection accuracy and reliability.

Further, the circuit module 32 of the sensing device 3 reads in the data of the target object distance and the intensity of ambient light measured by each optical sensor modules 322 for judging whether or not the respective coin tube 2 is empty. Thus, by means of reading in the data of the intensity of ambient light of high dynamic range detected by the ambient-light sensor and the data of reflected light detected by the proximity sensor, the coin storage status of the coin tube 2 can be known. If the coin tube 2 is empty, the traveling range and reflectivity of the reflected light from the bottom of the coin tube will be changed or reduced. At this time, another motor 131 of the coin hopper 13 is controlled to rotate the respective coin-delivering rotating disk 132 for discharging coins 4 from another coin tube 2 that is not empty to achieve the exchange, change or refund operation. At the same time, the display unit 151 of the face panel 15 is controlled to display the message of empty coin tube lights, text or graphics. When the replenisher arrives at the scene and sees the message of empty coin tube displayed by the display unit 151, the replenisher can then make the empty coin tube full of coins again.

On the contrary, if there is no significant change in the range and reflectivity of the reflected light, the coin tube 2 is judged to be not empty, and the display unit 151 is controlled to display the data of the amount of coins 4 currently accumulated in the coin tube 2 that is measured by the sensing device 3. Thus, the replenisher can decide whether or not to make the coin tube 2 full of coins again.

The method of the present invention enables the circuit module 32 of the sensing device 3 to read in data from the optical sensor modules 322 based on time-of-flight range sensing technology and the intensity of ambient light of high dynamic range for determination of an empty coin tube 2 or the amount of accumulated coins in each coin tube 2 accurately, ensuring a high level of reliability.

In conclusion, the coin dispenser 12 in the body shell 11 of the main body 1 is adapted for sorting different values of coins 4 and dispensing the main body 1 is adapted for sorting into different coin tubes 2; when the sensing device 3 is controlled to detect coins 4 in each coin tube 2, the circuit module 32 reads in the data of the time taken for the reflected light to travel from the coins 4 in the respective coin tube 2 to the respective optical sensor module 322 and the intensity of ambient light for calculation and analysis so that an empty status of the respective coin tube 2 or the amount of accumulated coins in the respective coin tube 2 can be determined.

When compared to the conventional optical sensor to measure the range to the target object distance by detecting the reflectivity or signal strength of reflected light, the implementation of the optical sensor modules 322 based on time-of-flight range sensing technology in accordance with the present invention can avoid interferences of the surface status (such as rugged surface, existence of pattern or color) of the coins 4, providing advantages of high accuracy, rapid response and low cost.

It is to be understood that the above-described embodiment of the invention is merely a possible example of implementations, merely set forth for a clear understanding of the principles of the invention, many modifications and enhancements may be made without departing from the spirit and scope of the invention. Accordingly, the invention is not to be limited except as by the appended claims.

What the invention claimed is:

1. A coin machine, comprising:

a main body comprising a body shell and a coin dispenser mounted in said body shell for sorting and dispensing coins of different values and sizes;

a plurality of coin tubes mounted in said body shell below said coin dispenser for collecting different values of coins from said coin dispenser, each said coin tube comprising a cylindrical coin passage and an opening in a top side thereof in communication with said cylindrical coin passage; and a sensing device mounted in said body shell between said coin dispenser and said coin tubes, said sensing device comprising a circuit module, said circuit module comprising a plurality of optical sensor modules respectively facing toward the said openings of the respective said coin tubes, each said optical sensor module combining a proximity sensor, an ambient-light sensor and a light source into a package;

wherein the distance between each said optical sensor module and the coins in the respective said coin tube is calculated based on time-of-flight range sensing technology: measuring the time taken for the reflected light to travel from the coins in the respective said coin tube or from the bottom of the coin tube back to the respective said optical sensor module and then multiplying the time thus measured by the speed of light, and the number of coins in the respective said coin tube is calculated by: deducting the distance between the respective said optical sensor module and the said coins in the respective said coin tube from the pre-measured depth of the empty said coin tube, and then dividing the remainder thus obtained by the thickness of one single said coin; and empty status of the respective said coin tube is measured subject to the intensity of ambient light.

2. The coin machine as claimed in claim 1, wherein said coin dispenser of said main body comprises a recognition module adapted for recognizing the authenticity and values of different coins, a coin inlet located in a top side of said recognition module for guiding each inserted coin into said recognition module, and a coin sorter module adapted for sorting coins been recognized by said recognition module and guiding sorted said coins into respective said coin tubes.

3. The coin machine as claimed in claim 1, wherein said coin tubes have different diameters to mate with respective said coins of different values and sizes.

4. The coin machine as claimed in claim 1, wherein said coins are metal coins.

5. The coin machine as claimed in claim 1, wherein said main body further comprises an accommodation chamber defined in said body shell for accommodating said coin tubes, and a coin hopper mounted in said accommodation chamber below said coin tubes for pushing coins out of said coin tubes for exchange, change or refund, said coin hopper being controllable to shift from one said coin tube that is empty to another said coin tube for discharging coins subject to the detection of said sensing device.

6. The coin machine as claimed in claim 5, wherein said main body further comprises a control module mounted in between a back wall of said body shell and said coin tubes and adapted for controlling the operation of said coin hopper, and a face panel with a display unit electrically connected to said control module for indicating messages of fault condition, accumulated number of coins, delivered number of coins and rested number of coins of each said coin tube, and parameter settings, said display unit being controllable by said control module to display the message of an empty coin tube detected by said sensing device, and the rest amounts of coins of each coin tube that has coins accumulated therein subject to the detection of said sensing device.

7. The coin machine as claimed in claim 5, wherein said coin hopper comprises a plurality of motors, and a plurality of coin-delivering rotating disks facing toward the respective said coin tubes and rotatable by the respective said motors to carry coins out of the respective said coin tubes.

8. The coin machine as claimed in claim 1, wherein said sensing device comprises a baffle-like base consisting of a first cover shell and a second cover shell; said circuit module of said sensing device is mounted in between said first cover shell and said second cover shell with said optical sensor modules disposed outside a bottom side of said baffle-like base.

9. The coin machine as claimed in claim 8, wherein said baffle-like base comprises a plurality of coin slots cut through said first cover shell and said second cover shell for the passing of said coins to go into the respective said coin tubes, and a plurality of sensor holes respectively located on said second cover shell adjacent to the respective said coin slots and respectively aimed at the said openings of said coin tubes for accommodating the respective said optical sensor modules.

* * * * *